United States Patent [19]

Vitta

[11] Patent Number: 4,912,358

[45] Date of Patent: Mar. 27, 1990

[54] PORTABLE CONTAINMENT DEVICE FOR TREATMENT OF HAZARDOUS MATERIALS

[75] Inventor: Michael F. Vitta, Salem, N.H.

[73] Assignee: Vitta Trust, c/o Michael F. Vitta, Trustee, Salem, N.H.

[21] Appl. No.: 265,552

[22] Filed: Nov. 1, 1988

[51] Int. Cl.[4] ..... A61G 11/00

[52] U.S. Cl. ..... 312/1; 312/3

[58] Field of Search ..... 312/1, 3, 5, 6, 283; 224/42.42, 42.45 R, 42.46 R; 15/227, 345; 134/6, 10, 21, 42; 138/97

[56] References Cited

U.S. PATENT DOCUMENTS

| | | | |
|---|---|---|---|
| 3,560,066 | 2/1971 | Jelatis et al. | 312/1 |
| 3,698,778 | 10/1972 | Townsend et al. | 312/1 |
| 4,626,291 | 12/1986 | Natale | 312/1 X |
| 4,746,175 | 5/1988 | Hamlet et al. | 312/3 X |
| 4,783,129 | 11/1988 | Jacobson | 312/3 X |

FOREIGN PATENT DOCUMENTS

| | | | |
|---|---|---|---|
| 1188191 | 6/1985 | Canada | 312/1 |
| 1567270 | 5/1980 | United Kingdom | 312/1 |
| 2157822A | 10/1985 | United Kingdom | 312/1 |
| 88/04964 | 7/1988 | World Int. Prop. O. | 312/1 |

*Primary Examiner*—Joseph Falk

*Attorney, Agent, or Firm*—Edward A. Gordon

[57] ABSTRACT

A device for stripping and receiving cladding material from an elongated body includes a flexible bag means having an upper portion adapted to surround a first section of an elongated body and a lower portion extending below the first section of the elongated body for receiving and retaining cladding material removed therefrom and first and second laterally extendable sleeve members which are attached to opposing sides of the upper portion of the bag means and adapted to surround adjacent sections of the first section of the elongated body. The bag means and sleeve members define a sealed enclosure about the elongated body sections. Each sleeve member has an expandable length greater than adjacent sections of the elongated body which they surround whereby the extendable sleeve members permit the bag means to be moved into positions below each of the adjacent sections of the elongated body surrounded by each sleeve member to receive and retain cladding material stripped therefrom.

17 Claims, 3 Drawing Sheets

PORTABLE CONTAINMENT DEVICE FOR TREATMENT OF HAZARDOUS MATERIALS

BACKGROUND OF THE INVENTION

1. Field Of The Invention

This invention relates to the removal of asbestos or other hazardous materials from an area of limited contamination, and more particularly to a new and improved portable containment and disposal device for use during such removal.

2. Description Of Prior Art

Asbestos-containing pipe insulation takes many forms, including chalky mixtures of magnesia and asbestos, preformed fibrous asbestos wrapping, asbestos fiber felt, corrugated paper, and insulating cement. In most cases, the insulating material is covered with a protective jacket (lagging) made of cloth, tape, paper, metal or cement. Occasionally, asbestos millboard is used as outside lagging on removable insulating covers for stiffness. Lagging on pipes and boilers prevents spontaneous fiber release and helps protect against disturbance.

Exposure to airborne asbestos regardless of the level, involves some health risks. When damage occurs to asbestos insulation and lagging on pipes and valves, repair and/or removal of the material is essential. The potential for exposure to airborne asbestos during such operations cannot be ignored. Worker protection is essential and is, in general, demanded by law. Proper work area containment is highly recommended for all abatement techniques. Once abatement work begins, all uninvolved persons should be kept out of the area.

Containment typically means construction of barriers with 6 mil polyethylene plastic sheets joined with folded seams, and with sealing tape at the seams and boundaries. Air locks and worker decontamination facilities with showers are recommended. So, too, are negative air pressure systems.

It should be noted that the removal of the asbestos insulation from the pipes and valves still requires safe packaging of the material for removal from the containment area for ultimate disposition. As a result, the use of protective apparatus in the form of flexible bags covering a body bearing fibrous material and/or protective clothing in the form of face masks and the like have become mandatory accessories to workmen involved with these operations.

Typically to assist in removing lagging materials from pipes and the like, a detachable bag which sealingly encompasses a section of the pipe is employed. This bag is formed with a pair of shaped flaps at its upper open end which are placed about a longitudinal portion of the pipe from opposite sides thereof so as to form an enclosure portion about the pipe. A fastening arrangement provided on the meeting edges of the flaps can then be operated to secure the bag to the pipe. The opposite ends of the flap portion can then be tied to sealingly engage the bag with the pipe. Generally the bag is also formed with a pair of arm portions which extend inwardly of the bag and which terminate with gloves so that an operator can insert his hands and perform manipulations within the interior of the bag for work on the pipe while maintaining isolation between the interior of the bag and the operator's hands. Thus fibrous material can be stripped from the pipe and collected within bag without risking exposure to the stripped fibrous material.

Exemplary of the state of the art of such flexible bag devices are U.S. Pat. No. 4,626,291 issued Dec. 2, 1986 and U.S. Pat. No. 4,746,175 issued May 29, 1988.

While such prior art devices provide improvement in the area intended, there still exists a need for a new and improved flexible containment and disposable device of a character which permits removal of lagging or cladding materials from pipes (or other elongated bodies) over greater lengths of the pipes and which is simple in construction, efficient in use and economical in manufacture.

Accordingly, a principal desirable object of the present invention is to provide a new and improved flexible containment and disposable device having the foregoing characteristics.

A still further desirable object of the present invention is to provide a containment unit which minimizes assembly components and maximizes ease of assembly.

A still further desirable object of the present invention is to provide a containment unit which can be easily constructed in various sizes.

These and other desirable objects of the invention will in part appear hereinafter and will in part become apparent after consideration of the specification with reference to the accompanying drawings and the claims.

SUMMARY OF THE INVENTION

The invention relates to improvements in or relating to stripping apparatus particularly adapted for stripping cladding material from a body.

In accordance with the invention there is disclosed a device for stripping and receiving cladding material from an elongated body including a flexible bag means having an upper portion adapted to surround a first section of the elongated body and a lower portion extending below the first section of the elongated body; a first extendable sleeve member surrounding a second section of the elongated body extending from one side of the first section; said first sleeve member having one end attached to the upper portion of the bag means and the other end adapted to be releasably sealed to the second section of said body member; a second extendable sleeve member surrounding a third section of the elongated body extending from the other side of said first section; said second sleeve member having one end attached to the opposing side of the upper portion of said bag means and the other end adapted to be releasably sealed to the third section of said body member; said bag means and said sleeve members defining a sealed enclosure; said sleeve members permitting said bag means to be moved into selected positions below each of the sections of said elongated body to receive and retain cladding material stripped therefrom; and means sealed to said bag means for protected access to the interior of said bag from the exterior of said bag. A sealed side port is provided in the bag means to allow access for wetting the cladding material and for evacuating the bag means with a suitable vacuum device to introduce a negative air pressure in the bag means during removal of the cladding material.

BRIEF DESCRIPTION OF THE DRAWING(S)

For a fuller understanding of the nature and desired objects of the invention, reference should be had to the following detailed description taken in connection with the accompanying drawings wherein like reference characters denote corresponding parts throughout the several views and wherein.

DETAILED DESCRIPTION OF PREFERRED EMBODIMENT(S)

Figure 1:
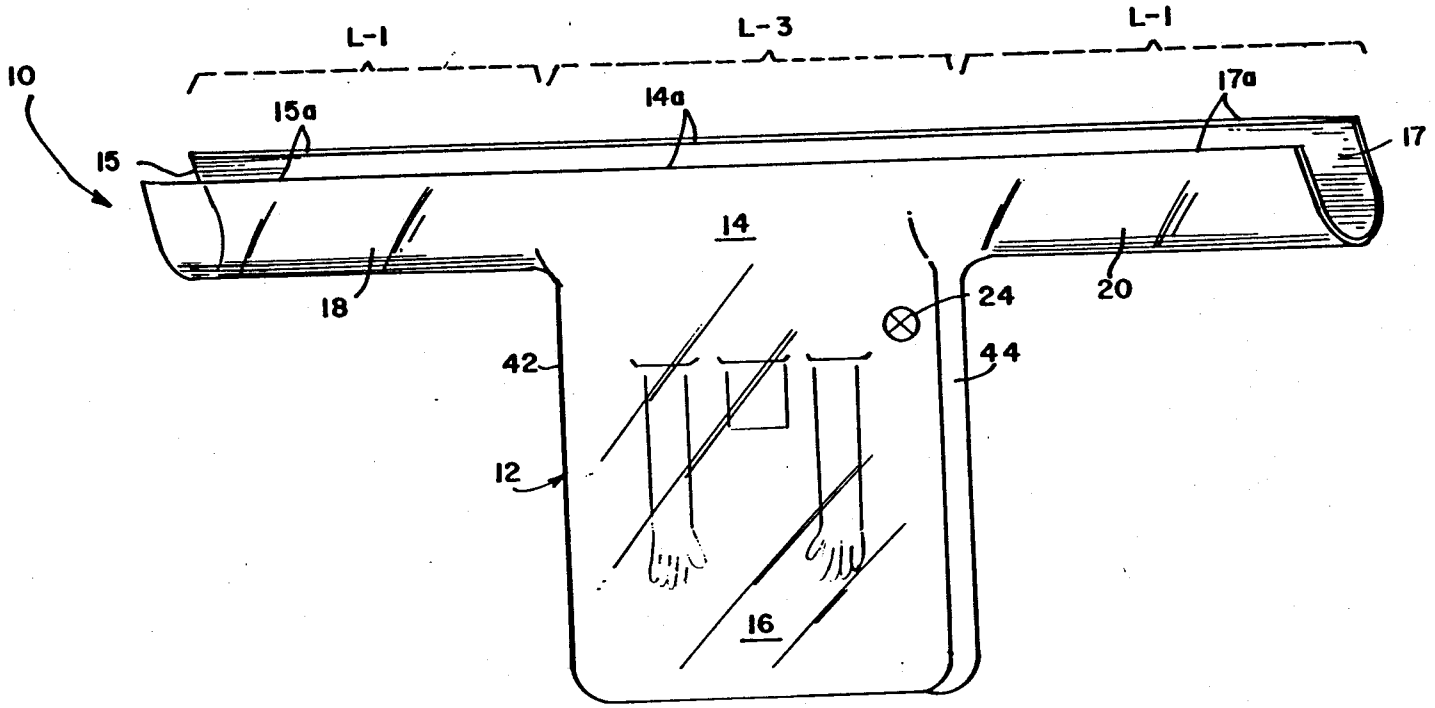
FIG. 1 is a perspective view of a containment device embodying the principals of the present invention.
Figure 2:
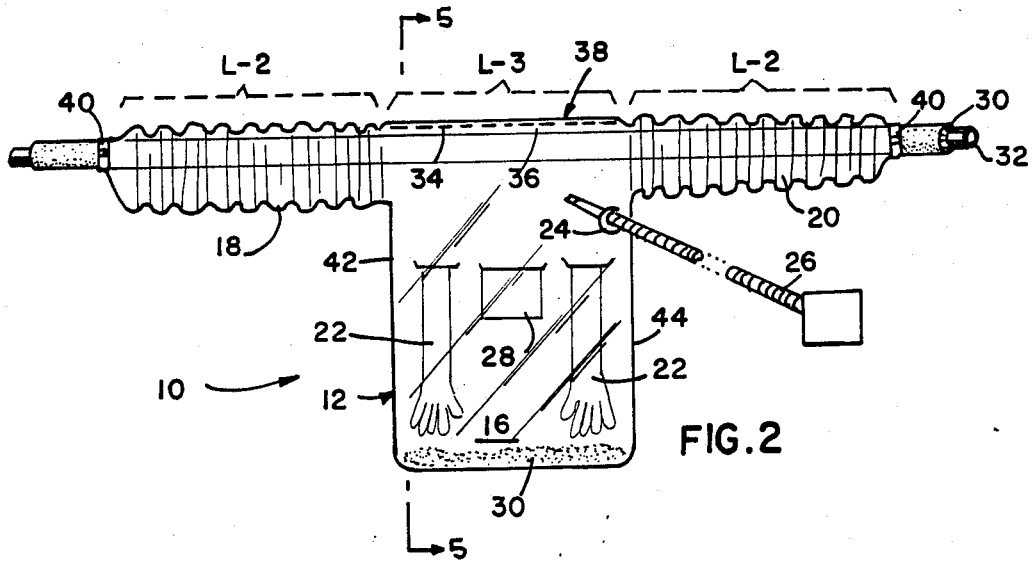
FIG. 2 is a perspective view showing the containment device of the present invention attached around an asbestos clad pipe section with an appropriate device in place to provide wetting of the asbestos material or a negative air pressure.
Figure 5:
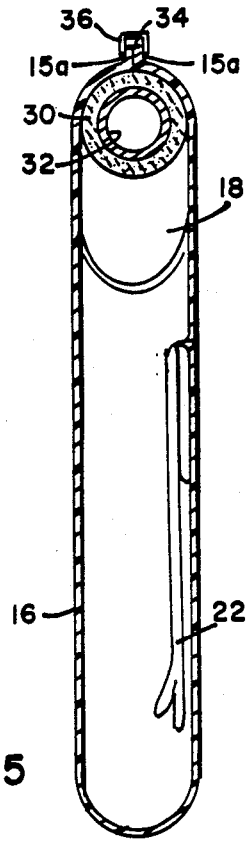
FIG. 5 is a cross sectional view taken along the line 5—5 of FIG. 2.

Referring now to the drawings, and particularly to FIGS. 1, 2 and 5, a containment device embodying the principals of the present invention is indicated generally by the numeral 10. The containment device 10 includes a generally transparent flexible plastic bag portion 12 having an upper open portion 14 defined by elongated flap end portions 14a and a lower closed portion 16. The containment device 10 further includes a pair of flexible sleeve portions 18 and 20 which extend laterally from the upper flap portions 14a of the bag portion, and, as shown are integral therewith and have upper open portions 15 and 17 defined by elongated flap end portions 15*a* and 17*a* similar to the upper open portion 14 of bag portion 12.

The bag portion 16 is equipped with sealed gloves 22 for hand access to the interior of the bag, a sealed port 24 to provide access for a suitable wetting device and/or vacuum device (such devices being represented generically by the device 26 of FIG. 2) and an interior tool pouch 28 which is preferably positioned generally between the two gloves 22 at a point adjacent to the level of attachment of the gloves.

Referring now more particularly to FIGS. 1 and 2, the application of the containment device 12 for the removal of asbestos insulation cladding 30 from an elongated pipe 32 is illustrated. The size of the upper open portions 14, 15 and 17 of bag 12 and the sleeve members 18 and 20 are selected to accommodate enclosure of pipe 32 and asbestos insulation 30 and permit the flap ends 14*a*, 15*a* and 17*a* to overlap a sufficient distance so that the ends can be sealed together with, for example, sufficient staples 34 and covering tape 36 to provide a suitable supporting seam illustrated generally by the numeral 38. Heat sealing can also be employed. The seam 38 will, in effect, support not only the weight of the containment device 10 but any cladding material removed from the pipe 32. The ends of the sleeve members 18 and 20 are sealed to the pipe by suitable means such as releasable straps 40. However, other sealing means such as tape can be employed.

One important feature of the present invention is that the length of the sleeve members in their extended positions as shown in FIG. 1 are provided with equal lengths beginning at the ends 42 and 44 of bag 12 and extending outwardly the length of the sleeve members as shown by the dotted lines and associated letters L-1. The length of the upper portion 14 of the bag 12 as shown by the dotted line and letter L-3 as well as the bottom portion 16 can be longer or shorter than the lengths L-1 of the extended sleeve members. Equally important is the feature that the sleeve members 18 and 20 are each adapted to be compressed or retracted to at least one half their lengths, as shown in FIG. 2 by the dotted lines and associated letters L-2, and then secured by straps 40 to the pipe 32 in the retracted position also as shown in FIG. 2.

Figure 3:
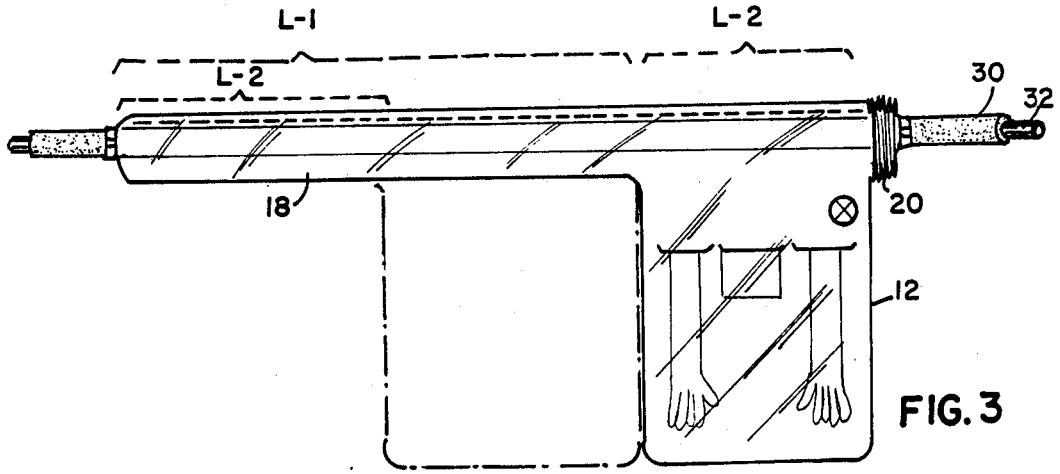
FIGS. 3 and 4 are schematic representations illustrating positions to which the bag means can be moved.
Figure 4:
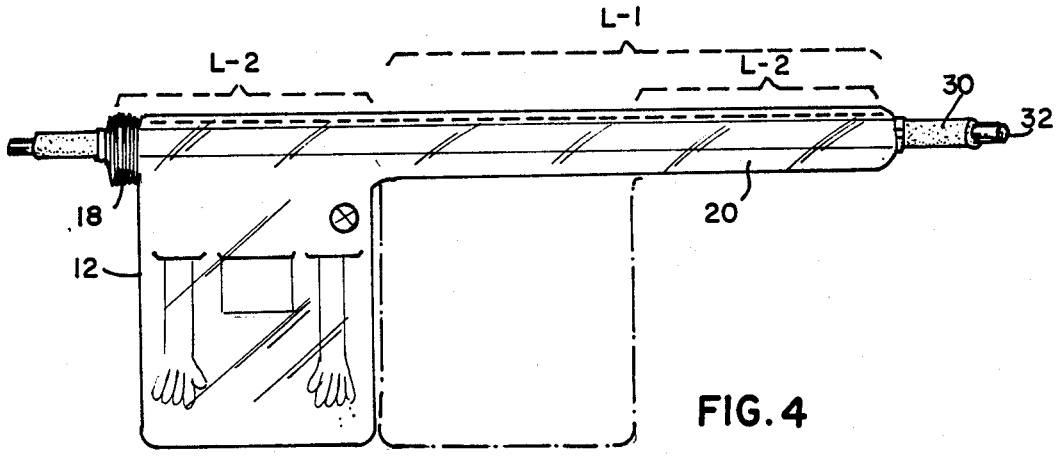

As best seen in FIGS. 3 and 4, the retracted lengths L-2, which as mentioned are ½ of the full length of the flexible sleeve members allows the bag member 12 to be moved laterally to the right and left to any and all positions along the section of the pipe which is enclosed between the end straps 40 of sleeve members 18 and 20 without the need of detaching the containment device. Accordingly in addition to the length of pipe enclosed by the center section, i.e., L-3, two additional lengths each equal to L-2, or a total additional length of L-1, can also be stripped. In this manner, greater sections of pipe can be stripped of cladding material than heretofore possible with prior art devices.

As shown in FIG. 3 when the bag 12 is moved as far as possible to the right, sleeve 18 is fully extended and sleeve 20 is fully retracted. Conversely, as shown in FIG. 4 when the bag 12 is moved as far as possible to the left the sleeve 20 is fully extended while sleeve 18 is fully retracted whereby the total length of pipe stripped is equal to the sum of L-1 plus L-3.

Figure 7:
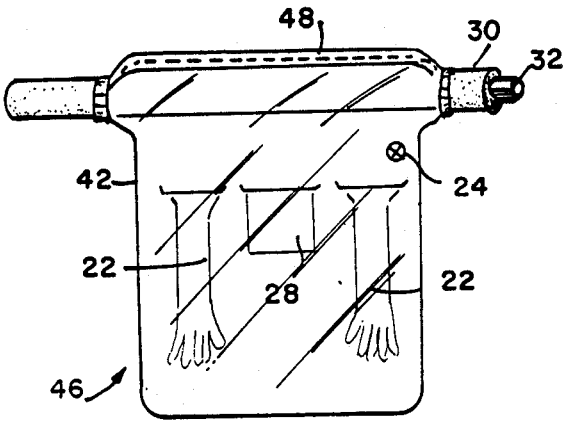
FIG.7 PRIOR ART
FIG. 7 is a perspective view of a typical prior art containment device.

Typically a prior art containment bag shown at 46 in FIG. 7 limits the length of pipe to be stripped to the width of the bag which is typically about three feet. Thereafter the seam 48 must be detached and the bag moved to an adjacent section to be stripped. Thus it can be seen that the present invention provides a substantial improvement in the art of removal of cladding material such as asbestos and other hazardous materials.

The use of water or other suitable liquid as a spray to reduce dust within the containment device and/or a vacuum device to provide a negative vacuum to keep the debris in the bottom portion 16 of the bag 12 are standard procedures in the art and need not be discussed in any further detail.

While not intended as a limitation it should be noted that the preferred embodiment of the present invention can utilize a 6 to 7 mil clear polyethylene for forming the containment device. The arm-glove combination can be made from DuPont Tyvek® arms with latex gloves.

The containment device can be produced by heat sealing appropriate lengths and configurations of polyethylene lay-flat tubing or sheet material. A tool pouch is formed also by heat sealing or otherwise laminating a "patch" of polyethylene film to the inside surface of the containment bag, the seal occurring on three sides of the patch, the fourth side remaining open toward the top for admission of tools or other material.

Figure 6:
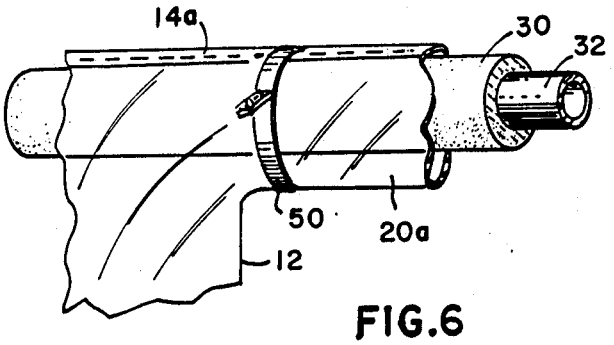
FIG. 6 is a fragmentary perspective view of an alternate embodiment of the sleeve member of the containment device in accordance with the present invention.

In an alternate embodiment as shown in FIG. 6 the sleeve members can be formed as a separate member 20*a* and attached to the upper portions 14*a* of bag 12 by suitable sealing means 50 such as pressure sensitive hook-and-loop type VELCRO (trademark) fasteners, or, staples and tape as discussed hereinbefore.

In a non-limiting example, a containment device in accordance with the present invention having a bag portion length (L-3) of 3 feet and sleeve members also having an extended length (L-1) of 3 feet and a retracted length (L-2) of 1.5 feet permits the bag member to be moved to each side 1.5 feet so that a total length of 6 feet of pipe can be stripped with one attachment of the containment device.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

I claim:

1. A device for stripping and receiving cladding material from an elongated body comprising:

a flexible bag means having an upper portion adapted to surround a first section of an elongated body and a lower portion extending below the first section of the elongated body to receive stripped cladding material;

a first retractable and extendable sleeve member surrounding a second section of the elongated body extending from one side of said first section and having a predetermined retractable length and extendable length;

said first sleeve member having the inner end attached to the upper portion of said bag means and the outer end adapted to be releasably sealed to the second section of said body member at a distance from the inner end equal to ½ the length of the first and second sections of the elongated body;

a second retractable and extendable sleeve member surrounding a third section of the elongated body extending from the other side of said first section;

said second sleeve member having the inner end attached to the opposing side of the upper portion of said bag means and the outer end adapted to be releasably sealed to the third section of said body member at a distance from the inner end equal to ½ the length of the first and third sections of the elongated body;

said bag means and said sleeve members defining a sealed enclosure; and means providing protected access to the interior of said bag means from the exterior of said bag means;

said sleeve members permitting said bag means to be moved into selected positions below each of the sections of said elongated body to receive and retain cladding material stripped therefrom.

2. A device in accordance with claim 1 wherein said bag means and sleeve members are formed of a flexible transparent plastic material.

3. A device in accordance with claim 1 further including means providing protected access to the interior of said bag means from the exterior of said bag means whereby an operator's hands can be inserted within said sealed enclosure to perform stripping operations.

4. A device in accordance with claim 1 wherein the protected access means include a pair of adjacent arm and glove means sealed to one side of the flexible bag means.

5. A device in accordance with claim 1 further including a tool pouch means attached to the inner surface of the flexible bag means intermediate the arm and glove means.

6. A device in accordance with claim 1 further comprising means for introducing negative air pressure into said bag means during removal of said cladding material.

7. A device in accordance with claim 1 further comprising means for introducing a liquid spray into said bag means during removal of said cladding material.

8. A device for stripping and receiving cladding material from an elongated body comprising:

a flexible bag means having an upper portion adapted to surround a first section of an elongated body and a lower portion extending below the first section of the elongated body for receiving and retaining cladding material removed therefrom;

first and second laterally extendable sleeve members releasably and sealingly attached to opposing sides of the upper portion of said bag means and adapted to surround adjacent sections of said first section of the elongated body;

said bag means and sleeve members defining a sealed enclosure;

said sleeve members each having an extendable length greater than said adjacent sections of the elongated body;

whereby said extendable sleeve members permit said bag means to be moved into positions below each of said adjacent sections of said elongated body to receive and retain cladding material stripped therefrom.

9. A device in accordance with claim 8 wherein the length of said first section of the elongated body enclosed by the upper portion of said bag means is substantially equal to the length of said bag means and the lengths of said adjacent sections of said elongated body are less than the lengths of said sleeve members when fully extended.

10. A device in accordance with claim 9 wherein the lengths of said adjacent sections of said elongated body are one-half the length of said sleeve members when fully extended.

11. A device in accordance with claim 8 wherein said bag means and sleeve members are formed of a flexible transparent plastic material.

12. A device in accordance with claim 11 wherein said transparent plastic material is polyethylene.

13. A device in accordance with claim 8 further including means providing protected access to the interior of said bag means from the exterior of said bag means whereby an operator's hands can be inserted within said sealed enclosure to perform stripping operations.

14. A device in accordance with claim 13 wherein said protected access means include a pair of adjacent arm and glove means sealed to one said of side bag means.

15. A device in accordance with claim 14 further including a tool pouch means attached to the inner surface of said bag means intermediate said arm and glove means.

16. A device in accordance with claim 8 further comprising means for introducing negative air pressure into said bag means during removal of said cladding material.

17. A device in accordnace with claim 8 further comprising means for introducing a liquid spray into said bag means during removal of said cladding material.

* * * * *